US005184353A

United States Patent [19]

Goldwitz

[11] Patent Number: 5,184,353

[45] Date of Patent: Feb. 9, 1993

[54] GOLF GLOVE CONSTRUCTION

[76] Inventor: David Goldwitz, 91 Country La., Milford, Conn. 06460

[21] Appl. No.: 753,314

[22] Filed: Aug. 30, 1991

[51] Int. Cl.[5] ..... A41D 19/00

[52] U.S. Cl. ..... 2/161 A; 273/187.2; 2/160

[58] Field of Search ..... 2/159, 161 A, 163, 161 R, 2/160, 169; 273/183 B, 166, 183 E, 188 R

[56] References Cited

U.S. PATENT DOCUMENTS

| | | | |
|---|---|---|---|
| 889,397 | 6/1908 | O'Shaughnessy | 2/161 A |
| 2,513,030 | 6/1950 | Lazarian | 2/159 |
| 2,655,662 | 10/1953 | Edler | 2/163 |
| 3,255,462 | 6/1966 | Antonious | 2/161 A |
| 3,762,719 | 10/1973 | Smith | 2/161 A X |
| 3,848,874 | 11/1974 | Elkins, Jr. | 273/183 B |
| 4,164,043 | 8/1979 | Fujita | 2/161 A |
| 4,962,547 | 10/1990 | Minnick | 2/161 A |

FOREIGN PATENT DOCUMENTS

| | | | |
|---|---|---|---|
| 949251 | 6/1974 | Canada | 2/163 |
| 2200275 | 8/1988 | United Kingdom | 2/159 |

OTHER PUBLICATIONS

*Golf Digest*, Oct. 1971 p. 73, "Sure Cure for Slicing".

*Primary Examiner*—Werner H. Schroeder
*Assistant Examiner*—Sara M. Current
*Attorney, Agent, or Firm*—Melvin I. Stoltz

[57] ABSTRACT

Providing highly visible, readily identifiable indicia on the rear surface of a golf glove in association with the knuckle area, a unique and highly useful golf glove is attained which enables a golfer to immediately realize the position of his knuckles on the shaft of the golf club and know whether the desired position has been realized. In the preferred embodiment, the indicia comprise markings or patches mounted to the golf glove and are constructed in varying sizes, enabling the indicia to be arranged in a graduated configuration to further enhance the immediate recognition and identification of the position of the knuckles on the club shaft. In a further embodiment, the golf glove of the present invention also comprises relief zones, for enabling the golfer to comfortably wear any and all rings on the fingers of the user throughout the golf game, and indicia formed on the inside surface of the glove for assisting the golfer in attaining the proper grip of the golf club shaft.

20 Claims, 2 Drawing Sheets

GOLF GLOVE CONSTRUCTION

TECHNICAL FIELD

This invention relates to golf glove constructions, and more particularly to a golf glove construction which is aesthetically pleasing and assists the wearer in proper hand positioning.

BACKGROUND ART

The sport of golfing has become increasingly popular over the years with numerous individuals of varying skill learning to play the game and participating in the game. In playing the game of golf, one of the principal requirements is the position of the hand on the shaft of the golf club in a precisely desired orientation, in order to attain the desired result when the golf club is swung to hit the golf ball.

In order to assist in securely holding a golf club, many golfers wear gloves and many prior art golf glove constructions have been made in an attempt to assist golfers in holding and positioning their hands properly. Although a great variety of prior art golf glove constructions are in existence, no prior art golf glove construction exists which is capable of quickly and accurately revealing to the golfer the propriety of any position of the hand on the golf club and the likely result to be realized.

In an attempt to assist the user in holding and positioning the golf club, prior art systems have been constructed with varying pockets or protrusions sewn onto the glove surface. In addition, various patches, or cooperating sections of mating gloves have been constructed in an attempt to assist the golfer, all with these prior art attempts failing to fill the requisite need.

Another failing found in prior art golf gloves is their inability to allow the user to comfortably wear jewelry, such as rings. Typically, the golf glove is tight fitting, in order to assure complete control over the golf club. However, this construction prevents the user from being able to keep rings on fingers, without binding or hurting the fingers of the user.

Therefore, it is a principal object of the present invention to provide a golf glove construction which is comfortable, aesthetically pleasing, and capable of enabling the wearer to immediately position the golf glove in the precisely desired orientation on the golf club, while also assuring, prior to swinging the golf club, that the precisely desired position has been attained.

Another object of the present invention is to provide a golf glove, having the characteristic features described above, which is attained without employing unwanted and cumbersome patches, pockets or protrusions formed on the glove surface.

Another object of the present invention is to provide a golf glove, having the characteristic features described above, which is constructed to enable the user to keep any rings on the fingers with complete comfort.

Other and more specific objects in part will be obvious and will in part appear hereinafter.

SUMMARY OF THE INVENTION

In the present invention, all of the prior art difficulties, drawbacks, and failings have been eliminated and a comfortable, easily-used, position-assuring golf glove is realized, which also allows rings to be comfortably worn in their normal manner. In attaining this golf glove construction, a plurality of various features are incorporated into the glove for providing specific assistance to the user. Although all of these features are desirable and are preferably incorporated into the glove, it is understood that these features may be used independently, without departing from the scope of the present invention.

One of the principal features incorporated into the glove construction of the present invention is the use of a plurality of independent indicia positioned across the zone of the glove which covers the knuckles of the user. By employing the indicia of this invention, the user is quickly and easily informed, by a single glance, the precise position or location of the user's knuckles relative to the golf club. In this way, the user immediately knows if the golf club is being held properly for the desired shot.

It is well known that most of the top teaching professionals of the game of golf instruct their students to observe the position of their knuckles on the golf club prior to swinging, in order to assure that their hands have been properly positioned. However, no prior art golf glove has been constructed which enables the user to immediately observe the precise position of his knuckles relative to the golf shaft prior to use of the golf glove in a manner which assures the user with a casual glance at his golf club. By employing the present invention, this prior art failing is eliminated, while still providing a golf glove which is completely in tact, in the knuckle area, and does not suffer from looseness or slippage otherwise found in some prior art gloves.

Following the instructions of the top teaching professionals in the game of golf, it is generally accepted that for most drives and long-ball shots, two knuckles of the golfer should be visible as the golfer glances down at his left hand, with the left hand wrapped about the shaft of the golf club in the ready position. In addition, if a specific shot in one direction is desired, one knuckle should be visible, while a hook in the opposed direction can best be achieved with three knuckles being visible.

Although these requirements are at the heart of good golfing instructions, no prior art golfing glove has been achieved which enables the user to see quickly, easily and accurately the number and position of one's knuckles on the golf club when the golf club is in the ready position. At best, some prior art golf gloves have incorporated contrasting sections forming the glove. However, these glove sections are incapable of performing the same function as the indicia means of the present invention.

Another feature of the present invention is the incorporation of indicia extending across the finger and palm area on the inside surface of the glove. The elongated indicia provides an alignment zone along which the user can visually align the shaft of the golf club while the hand is being wrapped about the golf club. In this way, precise alignment of the golf shaft is obtained for any particular shot, while the knuckle defining indicia provide a final positive visual indicator to position the angle of the club head to assure the user that the precisely desired orientation for control of the golf ball has been obtained.

One final feature incorporated into the golf glove of the present invention is the presence of relief zones formed on the outside surface of the finger areas, in the precise position where individuals normally have their rings positioned. One common difficulty golfers experience is the inability to comfortably retain one's normal rings on the fingers during the game of golf, while wearing a glove.

Since golf gloves are constructed for a close, tight fit, in order to assure control, any rings which are worn on the fingers tend to pinch and bind under the glove. As a result, most golfers remove their rings in order to play the game of golf when wearing a golf glove. This is extremely undesirable for many individuals, who feel comfortable with their rings being retained on their fingers, and do not want to remove their rings.

In order to satisfy the need, the glove of the present invention incorporates relief zones in the precise area of the glove which overlies the locations upon which rings are normally worn. In this way, the user is capable of keeping his rings on his fingers, with the relief zones enabling the rings to be completed accommodated without causing binding or discomfort to the user.

The invention accordingly comprises an article of manufacture, possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
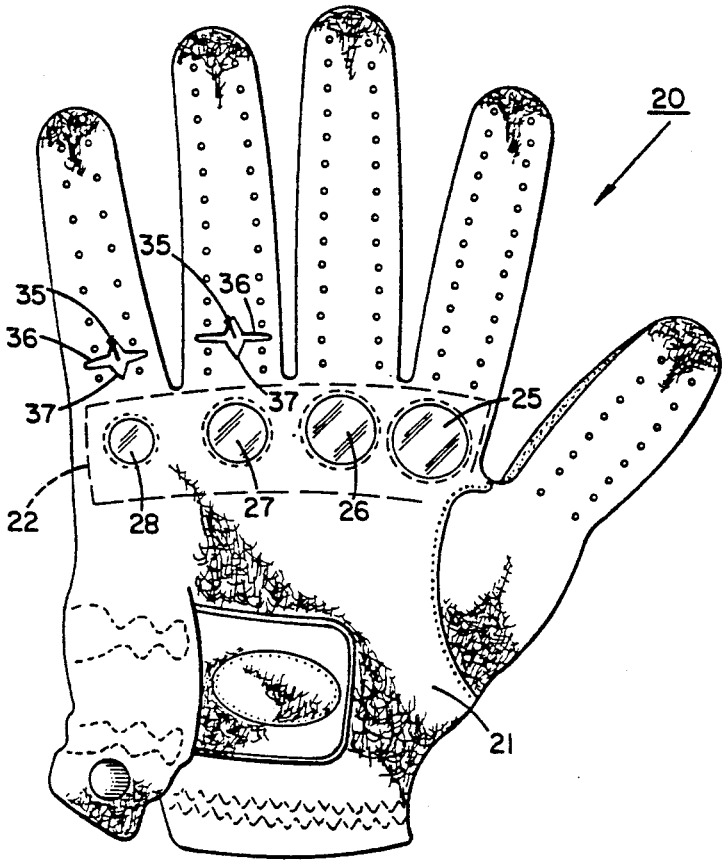
FIG. 1 is a plan view of the rear surface of a golf glove incorporating the present invention.

FIG. 1 depicts the back or rear surface 21 of a golf glove which incorporates the teaching of the present invention. As shown in FIG. 1, golf glove 20 comprises a generally conventional construction for being placed on the left hand of the user. However, in accordance with the present invention, glove 20 comprises a unique, plurality of indicia formed on rear surface 21 of glove 20 in the zone of glove 20 which covers and overlies the knuckles of the user. For purposes of discussion, this zone is shown by dotted lines and is referred to herein as knuckle zone 22.

As clearly evident from FIG. 1, knuckle zone 22 incorporates four separate, distinct, and independent indicia 25, 26, 27, and 28. Each of these indicia are precisely positioned in the location below which one knuckle of the wearer is located when the glove is placed on the wearer's hand.

In the preferred embodiment, indicia 25, 26, 27, and 28 are all immediately visually distinguishable, one from the other, preferably comprising graduated sizes. As depicted in FIG. 1, each of the indicia comprise a different diameter circle, printed on the glove surface. The largest diameter circle forms indicia 25, and each other indicia comprising a progressively smaller diameter circle, with indicia 28 having the smallest diameter.

In this way, immediately recognizable, Visually distinguishable indicia are provided, enabling the wearer to immediately know by a single glance the precise position of the golfer's knuckles relative to the shaft of the golf club. In this way, the user immediately knows if the golf club is being properly held for the desired shot.

Figure 2:
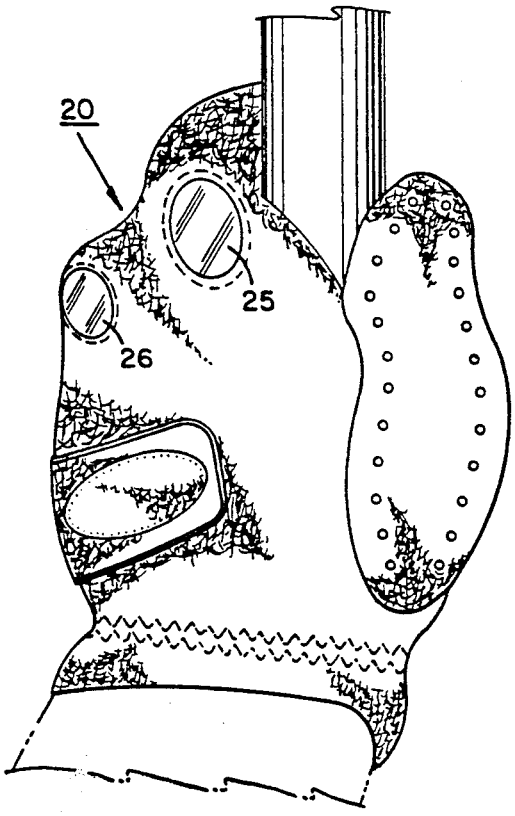
FIGS. 2–4 are perspective views depicting the golf glove of the present invention in use, holding the shaft of a golf club in various alternate positions.
Figure 3:
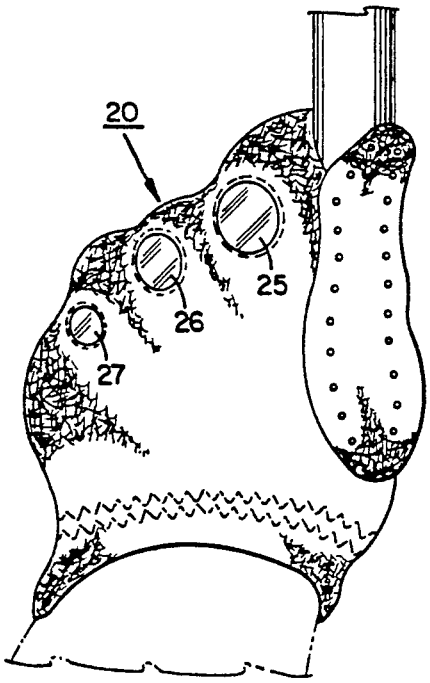
Figure 4:
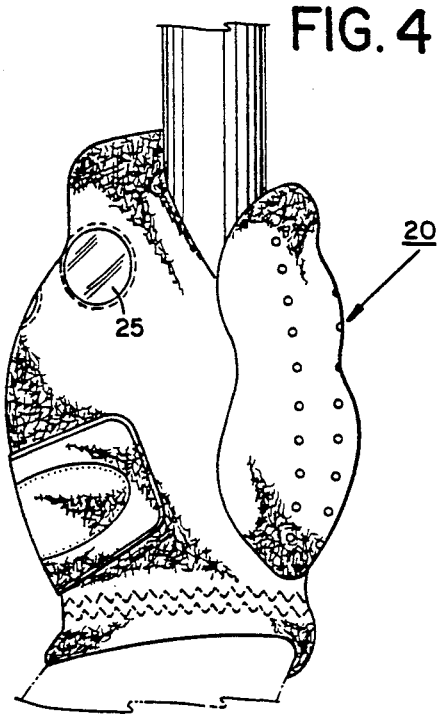

As clearly depicted in FIGS. 2, 3, and 4, by employing golf glove 20 of the present invention, the user is able to quickly and easily recognize whether the position of the hand on the glove club is the desired position or whether a change should be made. As discussed above, most of the top teaching professionals presently instruct their students that two knuckles should be visible to the user when gripping the shaft of the golf club and properly addressing the golf ball in order to obtain a straight drive. This position is depicted in FIG. 2.

As is evident from FIG. 2, by employing the present invention, the user is able to quickly and easily identify the first two knuckles and the position of the knuckles relative to the shaft of the golf club. As shown in FIG. 2, in the precisely desired position, the user is able to quickly identify the presence of indicia 25 and 26, thereby giving the user immediate and accurate knowledge that the grip presently being employed is the precise grip for obtaining a straight drive of the ball.

In the situation where a straight drive is not desired and the golfer wishes to hook the ball to either the left or the right, it is important for the golfer to rotate the shaft of the golf club to change the angle of the ball contacting surface. Depending upon which direction the golfer wishes the ball to travel, either one or three knuckles should be visible. These alternate positions are shown in FIGS. 3 and 4.

As is evident from a review of these figures, by employing golf glove 20 of the present invention with immediately identifiable, readily distinguishable indicia 25, 26, 27 and 28 incorporated therewith, the user is immediately able to identify the precise position and location of the user's knuckles on the shaft of the golf club when the golf club is being held. In this way, the user knows whether the precisely desired golf gripping position is obtained or whether a change should be made in order to hit the golf ball in the desired direction.

In FIG. 1, indicia 25, 26, 27 and 28 are depicted as circles of different diameters printed on the glove surface, in order to provide the readily distinguishable, independent, indicia taught by this invention. However, as is immediately apparent to one of ordinary skill in this art, printed circles of different diameters are not the only indicia that can be employed in order to attain the desired result.

Clearly, the indicia may comprise polygons or markings of any size or shape, with the overall sizes of each varying one to the other, in the preferred embodiment. Furthermore, indicia of various configurations could be intermixed with each other, such as squares, circles, triangles, and hexagons in order to attain readily distinguishable indicia in accordance with the present invention. If desired, alternate colors, marks or logos can be employed to designate the precise location of each knuckle in zone 21, without departing from the scope of the present invention.

In addition to placing or printing markings on zone 21 in order to form indicia 25, 26, 27, and 28, separate patches or pieces of material may also be affixed to glove 20 to attain the indicia in accordance with this invention. Furthermore, as shown in FIG. 5, an alternate configuration may incorporate indicia sewn on or formed on knuckle zone 21 in a position which designates the areas between the knuckles of the user, when glove 20 is being worn.

Figure 5:
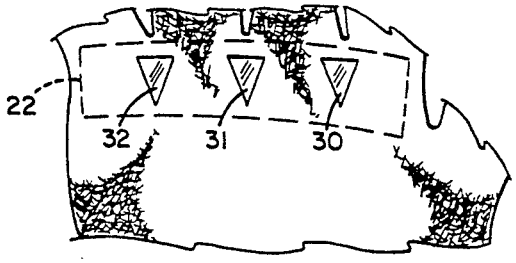
FIG. 5 is a plan view, partially broken away, depicting the knuckle area of the golfing glove of the present invention incorporating an alternate embodiment of the present invention.

As shown in FIG. 5, knuckle zone 21 is depicted with triangular shaped indicia 30, 31 and 32 formed thereon. In this configuration, instead of employing four separate and distinct indicia for each of the knuckles, three indicia are employed, positioned between the knuckles, thereby enabling the user to know the position of the knuckles by observing the space indicia 30 31 or 32.

In this embodiment, the user would know that the first two knuckles are in the proper position if the user sees indicia 30 and a portion of indicia 31. If three knuckles should be present, in order to hook the ball in one direction, the user should see indicia 30, 31 and a portion of 32. Finally, if only one knuckle should be visible, a portion of indicia 30 should be observed to assure the user that the proper grip has been achieved.

An additional feature incorporated into golf glove 20 of the present invention is the incorporation of relief zones 35 at the base of some or all of the finger retaining pockets of glove 20. As shown in FIG. 1, one embodiment of relief zone 35 comprises forming an elongated slit 36 in a direction transverse to the axis of the finger. Preferably, an additional slit 37 is also formed perpendicular to slit 36, in order to establish an opening through which the ring of the user can comfortably protrude, without interfering with the fit of the glove on the user.

Figure 6:
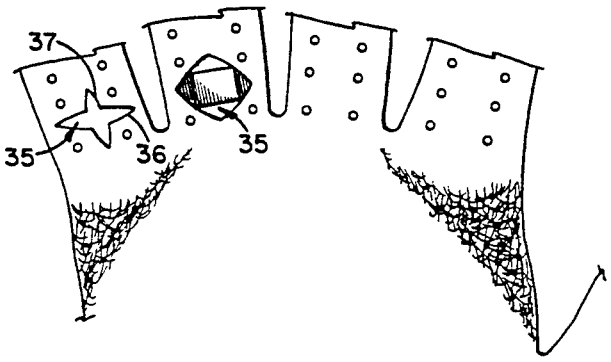
FIG. 6 is an enlarged view of one of the features of the present invention depicting the ring retaining zone of this invention.

As best seen in FIG. 6, slits 36 and 37 cooperate to form ring retaining relief zone 35 which enables any size ring of the wearer to be easily positioned and retained on the finger. When glove 20 is slipped on, the ring automatically opens zone 35, and protrudes therethrough. In this way, the user does not have to remove the rings normally worn on the hand in order to play golf. Instead, by employing glove 20 of this invention, the user can securely retain his rings in their normal position on the fingers with complete comfort.

If desired, ring retaining zone 35 can also be formed in a variety of alternate configurations. In one embodiment, zone 35 incorporates expandable material, either in an enlarged open zone forming ring retaining zone 35, or, if desired, as part of elongated slits 36 and 37. By incorporating expandable material in ring retaining zone 35, added comfort is achieved, while also assuring that glove 20 is securely and firmly retained on the hand of the user.

If desired, a plurality of ring retaining zones 35 may be formed on each of the elongated finger pockets of glove 20, in order to accommodate the presence of a ring on any finger of the user. Alternatively, ring retaining zones 35 are formed on the finger retaining pockets of glove 20 in association with only the fingers on which rings are normally worn. This would include the ring finger and the index finger, which are traditionally used by many individuals for rings, as depicted in FIG. 1.

Figure 7:
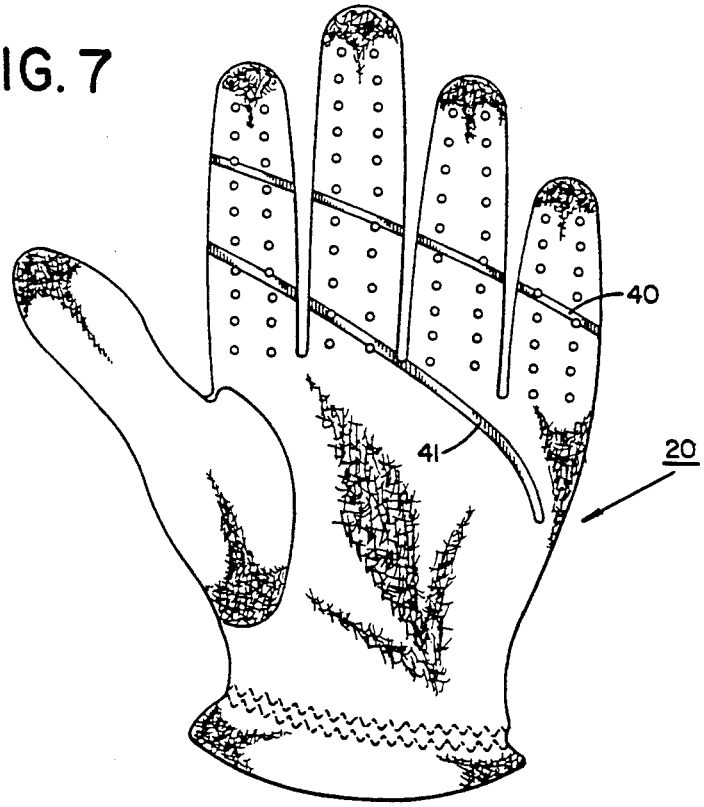
FIG. 7 is a plan view of the inside surface of a golf glove incorporating alternate features of the present invention.

In FIG. 7, a further unique aspect of glove 20 of the present invention is shown. In FIG. 7, the inside surface of glove 20 is shown with a plurality of position indicating bands 40 and 41, placed along the fingers and palm of the glove. Preferably, bands 40 and 41 comprise arcuate bands and are constructed merely by printing the bands in the appropriate zones on the finger and palm portions of the inside surface of glove 20. Alternatively, separate strips of material or other zone designating means can be employed.

When glove 20 is worn by the user and the user's fingers are cupped, in order to receive the shaft of the golf club, arcuate bands 40 and 41 become substantially straight lines due to the curvature of the fingers. Each of the bands 40 and 41 indicate to the user the preferred location for the shaft of the golf club.

In order to securely position a golf club shaft in position for being properly held, the shaft of the club should be placed directly between bands 40 and 42, with both bands being visible on the opposed side of the golf shaft. With the golf club in the precisely desired position, the entire club would then be gripped by the remainder of the hand, and the right hand then placed in position.

As a further check to be certain that the golf club is being held properly, the user would glance down to see the knuckle indicia 25, 26, 27 or 28, as detailed above. In this way, the user is able to be certain that the desired grip has been achieved for obtaining the particular type of shot desired.

Although arcuate bands 40 and 41 are depicted as elongated markings formed on the surface of glove 20, these indicia can take any desired form, such as different colored bands, different designs or strips of material affixed directly to the inside surface of glove 20. Regardless of which form is employed, any such zone designating means is within the scope of the present invention.

In the present invention, however, the zone designating means conform with the surface contours of glove 20 and do not require the use of projections or extensions emanating from the surface. Consequently, glove 20 of the present invention is easily constructed with surface contours identical to conventional gloves, while incorporating only visual indicia to enable the user to assure that the hand is positioned on the golf club in a precisely desired manner. Furthermore, additional bands could be employed for providing the user with further visual information.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A golf glove for assisting golfers in holding the shaft of a golf club in the precisely desired position for attaining a desired shot, said golf glove comprising A. a generally conventional glove construction for peripherally surrounding and covering the hand of the golfer, said glove incorporating a. a front surface for substantially covering the palm and coextensive finger surface of the hand of the user, and b. a rear surface interconnected to the front surface and constructed for covering the back surface of the hand of the user; and B. a plurality independent knuckle indicating means, each being a. positioned on the rear surface of the glove in overlying association with the position of one of the knuckles of the user when the glove is being worn and when the glove is in secure holding engagement with the shaft of a golf club, b. visually distinguishable from each other for enabling the user to immediately determine the position of each knuckle relative to the shaft of the golf club, and c. formed on the rear surface of the glove, substantially coextensive therewith, preventing any substantial protrusion or depression thereof from the surface, whereby the user is able to quickly and easily determine the precise position of his knuckles on the shaft of the golf club by merely glancing at his golf glove.

2. The golf glove defined in claim 1, wherein three knuckle indicating means are further defined as comprising three independent indicia, each being located directly over the area between two adjacent knuckles.

3. The golf glove defined in claim 2, wherein each of the three indicia comprises triangular shaped marking formed on the glove surface.

4. The golf glove defined in claim 1, wherein the knuckle indicating means is defined as comprising at least one selected from the group consisting of geometric shaped markings, patches, designs, logos, and stitchings.

5. The golf glove defined in claim 1, wherein the knuckle indicating means are further defined as comprising four independent indicia, each positioned in overlying alignment with the position of one knuckle of the user wearing the glove and holding the shaft of the golf club.

6. The golf glove defined in claim 5, wherein each of the knuckle indicating indicia are further defined as comprising geometric shaped markings formed on the rear surface of the glove.

7. The golf glove defined in claim 6, wherein each of the geometric shaped indicia are further defined as comprising different sizes.

8. The golf glove defined in claim 7, wherein said circular shaped indicia are further defined as being arranged in a progressive pattern, with the largest sized marking overlying the knuckle of the first finger and the smallest sized marking overlying the knuckle of the little finger.

9. The golf glove defined in claim 1, and further comprising

C. at least one relief zone a. formed in the rear surface of the glove at the proximal end of a finger receiving pocket, and b. constructed for expanding to receive a ring mounted on the finger for allowing the ring to be retained on the finger with comfort.

10. The golf glove defined in claim 9, wherein said relief zone is further defined as comprising two intersecting slits formed in the glove surface, enabling the ring to spread the slits apart and be retained therein.

11. The golf glove defined in claim 1, and further comprising

C. a plurality of elongated indicia each indicia a. being formed on the front surface of the glove b. extending across the surface of the glove covering at least one selected from the group consisting of at lest three of the user's fingers and the combination of at least two of the user's fingers and the user's palm c. establishing a substantially continuous visual designation for identifying the preferred placement position for the shaft of the golf club.

12. The golf glove defined in claim 11, wherein said indicia comprise bands formed on the front surface of the glove.

13. The golf glove defined in claim 12, wherein said bands comprise different colors.

14. The golf glove defined in claim 11, wherein said indicia comprise strips of material affixed to the surface of the glove.

15. A golf glove for assisting golfers in holding the shaft of a golf club in the precisely desired position for attaining a desired shot, said golf glove comprising A. a generally conventional glove construction for peripherally surrounding and covering the hand of the golfer, said glove incorporating a. a front surface for substantially covering the palm and coextensive finger surfaces of the hand of the user, and b. a rear surface interconnected to the front surface and constructed for covering the back surface of the hand of the user;

B. a plurality of independent knuckle indicating means, each being a. positioned on the rear surface of the glove in overlying association with the position of one of the knuckles of the user when the glove is being worn and when the glove is in secure holding engagement with the shaft of a golf club, b. visually distinguishable from each other for enabling the user to immediately determine the position of each knuckle relative to the shaft of the golf club; and c. formed on the rear surface of the glove, substantially co-extensive therewith, preventing any substantial protrusion or depression thereof from the surface, C. a plurality of elongated indicia each indicia a. being formed on the front surface of the glove b. extending across the surface of the glove covering at least one selected from the group consisting of at least three of the user's fingers and the combination of at least two of the user's fingers and the user's palm c. establishing a substantially continuous visual designation for identifying the preferred placement position for the shaft of the golf club; and D. at least one relief zone a. formed in the rear surface of the glove at the proximal end of a finger receiving pocket, and b. constructed for expanding to receive a ring mounted on the finger for allowing the ring to be retained on the finger with comfort.

16. A golf glove for assisting golfers in holding the shaft of a golf club in the precisely desired position for attaining a desired shot, said golf glove comprising A. a generally conventional glove construction for peripherally surrounding and covering the hand of the golfer, said glove incorporating a. a front surface for substantially covering the palm and coextensive finger surfaces of the hand of the user, and b. a rear surface interconnected to the front surface and constructed for covering the back surface of the hand of the user; and B. four separate, independent knuckle indicating means formed on the rear surface of the glove, with each of said knuckle indicating means a. being positioned on the rear surface of the glove in overlying alignment with the position of one of the knuckles of the user when the glove is worn and is in secure, holding interengagement with the shaft of a golf club, and b. comprising a unique, readily distinguishable, easily identifiable size or shape for visually distinguishing each of said indicating means from the other for enabling the user to immediately identify the particular indicating means being viewed and determine the position of each knuckle relative to the shaft of the golf club whereby the user is able to quickly and easily determine the precise position of his knuckles on the shaft of the golf club by merely glancing at the golf glove being worn.

17. The golf glove defined in claim 16, wherein said four independent knuckle indicating means are further defined as comprising at least one selected from the group consisting of geometric shaped markings, patches, designs, logos, and stitchings.

18. The golf glove defined in claim 17, wherein each of said knuckle indicating indicia are further defined as comprising similar geometric shaped patterns of different sizes.

19. The golf glove defined in claim 18, wherein each of said geometric shaped indicia are further defined as being arranged in an orderly pattern, with the largest size geometric shape indicia overlying the knuckle of the first finger and the smallest size geometric shaped indicia overlying the knuckle of the little finger.

20. A golf glove for assisting golfers in holding the shaft of a golf club in the precisely desired position for attaining a desired shot, said golf glove comprising A. a generally conventional glove construction for peripherally surrounding and covering the hand of the golfer, said glove incorporating a. a front surface for substantially covering the palm and coextensive finger surfaces of the hand of the user, and b. a rear surface interconnected to the front surface and constructed for covering the back surface of the hand of the user; and B. at least two separate, independent knuckle indicating means formed on the rear surface of the glove, with said knuckle indicating means a. being positioned on the rear surface of the glove in overlying alignment with the position of the knuckles of at least the first and the second fingers of the suer when the glove is worn and is in secure, holding interengagement with the shaft of a golf club, and b. comprising a unique, readily distinguishable, easily identifiable size or shape for visually distinguishing each of said indicating means from the other for enabling the user to immediately identify the particular indicating means being viewed and determine the position of each knuckle relative to the shaft of the golf club whereby the user is able to quickly and easily determine the precise position of the knuckles of at least his first and second fingers on the shaft of the golf club by merely glancing at the golf glove being worn.

* * * * *